United States Patent [19]

Ito et al.

[11] 4,412,600

[45] Nov. 1, 1983

[54] HYDRAULIC ELEVATOR

[75] Inventors: Takuzo Ito; Tadashi Suzuki; Tatsuro Miyake, all of Inazawa, Japan

[73] Assignee: Mitsubishi Denki Kabushiki Kaisha, Tokyo, Japan

[21] Appl. No.: 247,716

[22] Filed: Mar. 26, 1981

[30] Foreign Application Priority Data

Mar. 26, 1980 [JP] Japan ..... 55-38782

[51] Int. Cl.[3] ..... B66B 11/04

[52] U.S. Cl. ..... 187/17; 192/41 R

[58] Field of Search ..... 187/17, 9 R, 28; 192/41 R, 0.07; 417/20, 21, 23, 316; 60/419, 431, 435, 441; 303/10

[56] References Cited

U.S. PATENT DOCUMENTS 2,932,257 4/1960 Lupin ..... 60/419

3,841,093 10/1974 Smith ..... 60/431

FOREIGN PATENT DOCUMENTS 50-7814 3/1975 Japan .

54-162355 12/1979 Japan ..... 187/17

OTHER PUBLICATIONS

"Hydraulics & Pneumatics"; Salmon et al.; pp. 53–56; Jun. 1979.

*Primary Examiner*—Kenneth W. Noland

*Attorney, Agent, or Firm*—Oblon, Fisher, Spivak, McClelland & Maier

[57] ABSTRACT

A hydraulic elevator for ascending and descending operation of a car by feeding or discharging a hydraulic fluid through a flow rate control device between a hydraulic pump connected to a reversible motor and a hydraulic cylinder. The elevator includes a one-way clutch connected between the motor and the hydraulic pump so as to transmit the normal driving force of the motor to the hydraulic pump in the ascending operation of the car and to apply regenerative braking force to the hydraulic pump in the descending operation of the car when the revolution speed of the hydraulic pump is increased over the synchronous speed of the reverse rotation of the motor.

5 Claims, 5 Drawing Figures

HYDRAULIC ELEVATOR

BACKGROUND OF THE INVENTION

1. Field of the Invention

The present invention relates to a hydraulic elevator for ascending and descending a car by feeding a hydraulic fluid to a hydraulic cylinder or discharging it. More particularly, it relates to a hydraulic elevator which controls the speed of the car in the descending operation by regenerative braking of a motor for driving a hydraulic pump.

2. Description of the Prior Art

Heretofore, in the descending operation of the car of the conventional hydraulic elevator, the dead weight of the car and a plunger has been used and the speed has been controlled by controlling flow rate of a hydraulic fluid discharged from the hydraulic cylinder through a flow rate control valve.

In such descending operation, however, pressure energy is converted into heat energy at the throat of the flow rate control valve thereby causing severe elevation of the temperature of the hydraulic fluid to deteriorate the hydraulic fluid. Moreover, the flow of the hydraulic fluid passing through the flow rate control valve becomes high speed flow to cause cavitation and the noise and vibration caused by the cavitation are disadvantageously propagated to the car.

The following system has been proposed to overcome the above-mentioned disadvantages.

The motor is reversely rotated during the descending operation of the car to rotate reversely the hydraulic pump so as to discharge the hydraulic fluid from the hydraulic cylinder and when the descending speed of the car increases to increase the revolution speed of the hydraulic pump resulted by the discharge of the hydraulic fluid over the synchronous speed of the motor, the motor is actuated as the dynamo to apply regenerative braking to the hydraulic pump so as to control the speed. In such system, however, if the speed of the motor does not correspond to the opening operation of the check valve at the start of the descending operation of the car, the fluid is not fully fed in the suction side of the hydraulic pump to cause negative pressure and to disturb the opening operation of the check valve and to cause cavitation. Sometime, the hydraulic pump may be broken. In the decceleration, a similar problem occurs. Therefore, it has been required to correspond the starting and stopping operation of the motor to the operation of the valve. It has been required to control by fine control which is expensive.

SUMMARY OF THE INVENTION

It is a first object of the present invention to overcome the trouble caused by competition between a motor and a valve in the conventional system and to provide a hydraulic elevator in an economical regenerative braking system.

It is a second object of the present invention to improve regenerative efficiency.

The foregoing and other objects have been attained by providing a hydraulic elevator which comprises a reversible motor, a hydraulic cylinder, a hydraulic pump, a flow rate control device and a one-way clutch connected between the motor and the hydraulic pump so as to transmit the normal driving force of the motor to the hydraulic pump in the ascending operation of the car and to apply regenerative braking force to the hydraulic pump in the descending operation of the car when the revolution speed of the hydraulic pump is increased over the synchronous speed of the reverse rotation of the motor.

DETAILED DESCRIPTION OF THE PREFERRED EMBODIMENTS

Figure 1:
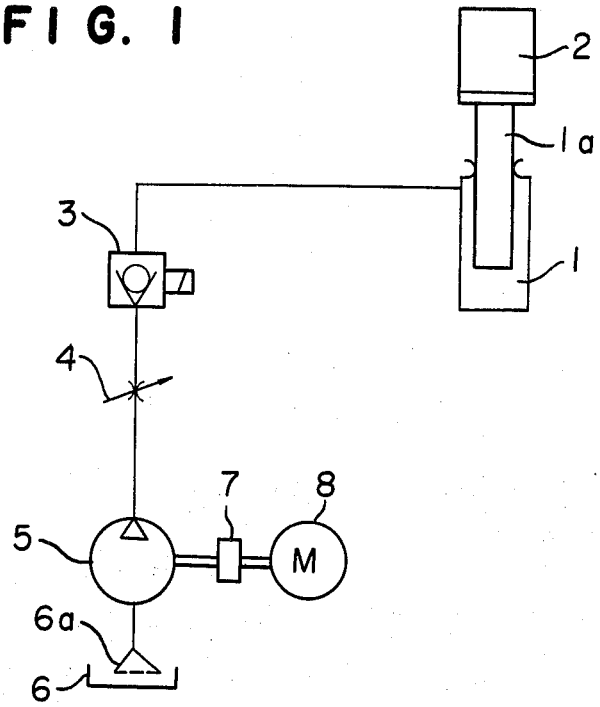
FIG. 1 is a diagram of a hydraulic circuit as one embodiment of a hydraulic elevator according to the present invention.

Referring to the drawings, one embodiment of the present invention will be illustrated.

FIG. 1 shows the first embodiment of a hydraulic circuit for a hydraulic elevator according to the present invention. The reference (1) designates a hydraulic cylinder having a plunger **(1*a*) and (2) designates a car which is directly connected to the plunger (1*a*) of the hydraulic cylinder (1). The hydraulic cylinder (1) is connected through a solenoid operation check valve (3) and a flow rate control valve (4) to an outlet of a hydraulic pump (5). The suction inlet of the hydraulic pump (5) is connected through a strainer (6*a*) to an oil tank (6). The hydraulic pump (5) is connected through a one-way clutch (7) to a reversible motor (8). On the other hand, one-way clutch (7) is engaged during the positive rotation of the motor (8) so as to transmit the rotation of the motor to the hydraulic pump (5) whereby ascending of the hydraulic elevator is carried out. In the descending of the hydraulic elevator, the motor (8) is reversely rotated. The action of the motor (8) is not transmitted to the hydraulic pump (5). When the revolution speed of the hydraulic pump (5) caused by the hydraulic fluid in the hydraulic cylinder (1) in the ascending operation is increased over the speed of the reverse rotation of the motor (8) (synchronous speed), the one-way clutch (7) is interlocked to actuate the motor (8)** as a dynamo so as to perform a regenerative braking.

The operation of the hydraulic circuit having the abovementioned structure will be illustrated.

In the ascending operation of the car (2), the motor (8) is driven in the normal rotating direction and the rotation is transmitted through the one-way clutch (7) to the hydraulic pump (5) to rotate the hydraulic pump (5) at a rated speed. The hydraulic fluid resulted by the actuation of the pump is fed through the flow rate control valve (4) and a solenoid operation check valve (3) to the hydraulic cylinder (1) whereby the plunger **(1*a*) is ascended to lift the car (2). The speed control from the start to the floor landing of the car (2) i.e., acceleration constant speed running and decceleration of the car, is controlled by the flow rate control valve (4)**.

Figure 2:
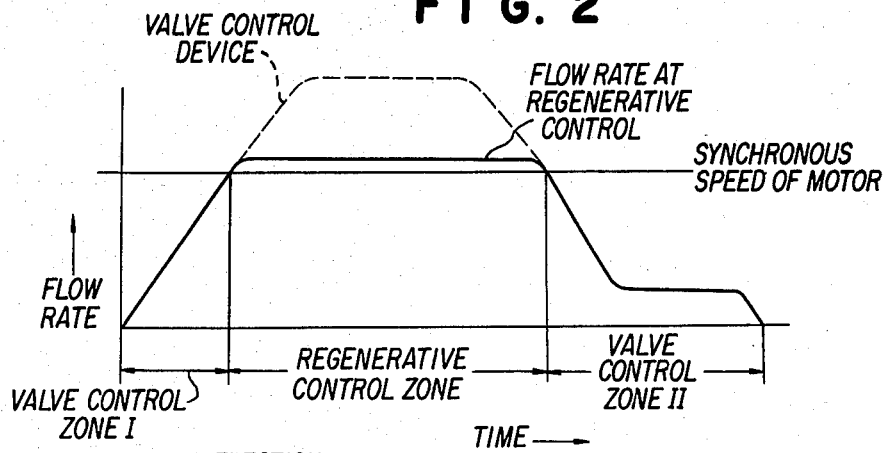
FIG. 2 is a graph for showing the flow rate control during descending operation of the hydraulic elevator by the hydraulic circuit.

In the descending operation of the car (2), the motor (8) is reversely rotated but it is freely rotated by the one-way clutch (7) whereby the rotation is not transmitted to the hydraulic pump (5). On the other hand, when the solenoid operation check valve (3) is opened, the hydraulic fluid fed out of the hydraulic cylinder (1) under dead weight of the car (2) and the plunger (1*a*) is returned through the check valve (3), the flow rate control valve (4) and the hydraulic pump (5) to the oil tank (6). The returning hydraulic fluid rotates the hydraulic pump (5) in the reverse direction to the normal rotating direction. That is, it performs function as one kind of a hydraulic motor. When the flow rate control valve (4) is gradually opened under acceleration command, the flow rate of the returning hydraulic fluid controlled by the valve (corresponding to the valve control zone I shown in FIG. 2) increases whereby the revolution speed of the hydraulic pump (5) increases depending upon the increase of the flow rate of the hydraulic fluid and the descending speed of the car (2) is accelerated.

When the revolution speed of the hydraulic pump (5) depending upon the flow rate controlled by the flow rate control valve (4) is increased over the synchronous speed of the motor (8), the hydraulic pump (5) is engaged with the motor (8) through the interlocking operation of the one-way clutch (7), whereby the motor (8) is rotated at a speed over the synchronous speed, and as a result is actuated as an induction generator and simultaneously the regenerative braking is applied to the hydraulic pump (5). Therefore, the motor (8) is rotated at a speed slightly faster than the synchronous speed given by the torque-slip curve. The flow rate of the hydraulic fluid discharged from the hydraulic pump (5) is controlled to slightly higher than the flow rate of the fluid fed into the hydraulic cylinder (1) in the ascending operation (corresponding to the regenerative control zone shown in FIG. 2). Therefore, the car (2) lowers at a substantially constant speed corresponding to the flow rate of the fluid discharged from the hydraulic pump which is set depending upon the regenerative braking. The flow rate control of the flow rate control valve (8) in the regenerative control zone is performed along the broken line shown in FIG. 2.

When the flow rate control valve (4) is gradually closed by the decceleration command in the floor landing of the car (2) which has been descending at a constant speed, and the flow rate is decreased below the flow rate of the fluid discharged from the hydraulic pump (5), the hydraulic pressure applied to the hydraulic pump (5) is decreased to decrease the revolution speed. When the revolution speed of the hydraulic pump is decreased below the synchronous speed of the motor (8), the one-way clutch (7) is disengaged again whereby the flow rate control under the regenerative braking is released and simultaneously it is changed into the valve control zone II by the flow rate control valve (4) (see FIG. 2). Therefore, the descending speed of the car (2) is decelerated by the flow rate control valve (4) operated under the flow rate pattern of the valve control zone II shown in FIG. 2 so as to stop the car at the landing position.

Figure 3:
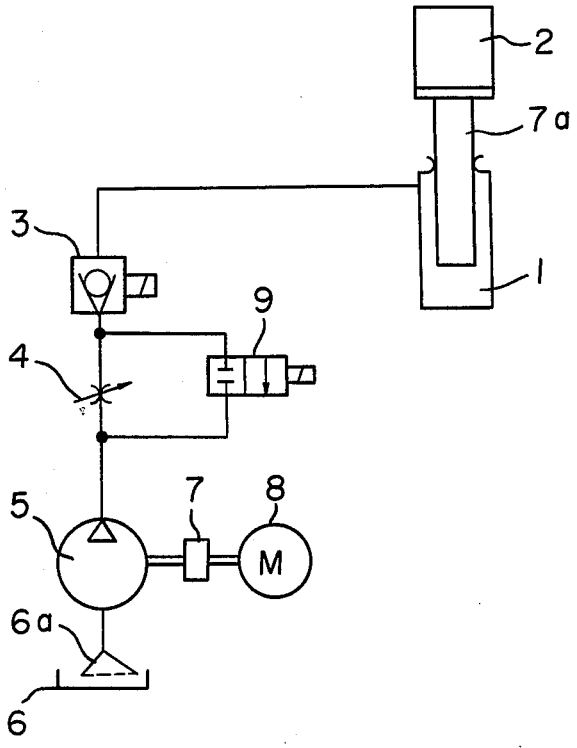
FIG. 3 is a diagram of the other embodiment of the hydraulic elevator according to the present invention.

FIG. 3 shows the second embodiment of the present invention. In FIG. 3, the same references designate the identical or corresponding parts shown in FIG. 3. The description of the parts are not repeated and only the different parts will be mainly illustrated.

Figure 4:
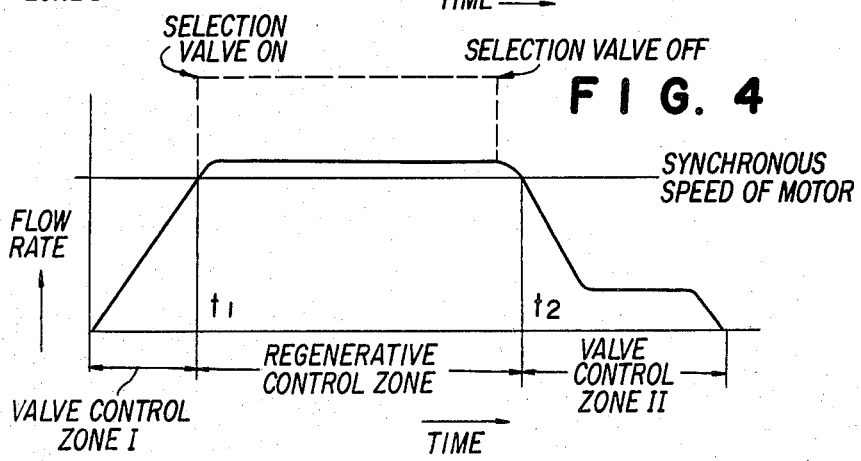
FIG. 4 is a graph for showing the flow rate control during the descending operation of the hydraulic elevator by the hydraulic circuit.

In the embodiment shown in FIG. 3, the electromagnetic selector valve (9) is connected in parallel to the flow rate control valve (4) in the hydraulic circuit having the structure shown in FIG. 1, whereby the flow rate control valve (4) is actuated only in the flow rate control zone during the acceleration or decceleration descending operation of the car (2). In the regenerative braking control zone, the electromagnetic selector valve (9) is opened without the operation of the flow rate control valve (4) as the broken line shown in FIG. 2. That is, during the descending operation of the car (2), the motor (8) is reversely rotated as the same shown in FIG. 1 and the solenoid operation check valve (3) is opened and the flow rate control valve (4) is gradually opened under the acceleration command to give the flow rate change corresponding to the valve control zone I shown in FIG. 4 whereby the car (2) descends and simultaneously the hydraulic pump (5) is reversely rotated. When the revolution speed of the hydraulic pump (5) reaches to the synchronous speed of the motor (8), the flow rate control operation of the flow rate control valve is stopped at this time ($t_1$ point in FIG. 4) and the opening condition is maintained and the electromagnetic selector valve (9) is simultaneously opened to by-pass the hydraulic fluid from the hydraulic cylinder (1) into the hydraulic pump (5). The flow rate of the fluid passed through the electromagnetic selector valve (9) into the hydraulic pump (5) is shown by the broken line shown in FIG. 4.

When the revolution speed of the hydraulic pump (5) is increased over the synchronous speed of the motor (8), the one-way clutch (7) is interlocked to rotate the motor (8) at a speed over the synchronous speed whereby the regenerative braking is applied to the hydraulic pump (5). Therefore, the flow rate of the fluid discharged from the hydraulic pump (5) becomes constant as shown by the regenerative braking zone shown in FIG. 4 to descend the car (2) at substantially constant speed. When the decceleration command is given for the floor landing of the car (2) in the descending operation at a constant speed (the time $t_2$ point shown in FIG. 4), the electromagnetic selector valve (9) is closed to change the fluid passage to the flow rate control valve (4) and simultaneously, the flow rate control valve (4) is gradually closed from the opening degree at the time $t_1$ point so as to reduce the flow rate of the fluid fed from the flow rate control valve (4) to the hydraulic pump (5). When the revolution speed of the hydraulic pump (5) is decreased below the synchronous speed of the motor (8), the one-way clutch (7) is disengaged to separate the hydraulic pump (5) from the motor (8). The flow rate control under the regenerative braking is released to change into the flow rate control by the flow rate control valve (4). The flow rate is controlled along the flow rate pattern in the valve control zone II shown in FIG. 4 to decelerate the descending speed of the car (2).

In this embodiment, the competition between the check valve (3) and the motor (5) can be prevented as the embodiment shown in FIG. 1 and the flow rate resistance caused by the flow rate control valve (4) can be reduced by the electromagnetic selector valve (9) whereby the regenerative efficiency can be improved. Moreover, the flow rate control valve (4) is not operated at the opening degree for the speed over the rated speed of the car and accordingly, the flow rate of the fluid passed into the hydraulic pump (5) does not increase even though the regenerative braking is inactivated by electrical power failure. Therefore trouble can be reduced in comparison with the embodiment shown in FIG. 1.

Figure 5:
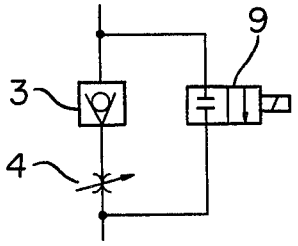
FIG. 5 is a diagram of the other embodiment of the hydraulic circuit according to the present invention.

In the embodiment shown in FIG. 3, the electromagnetic selector valve (9) is connected in parallel to the flow rate control valve (4). It is also possible to connect the electromagnetic selector valve in parallel to a serial circuit of the flow rate control valve (4) and the solenoid operation check valve (3) as shown in FIG. 5. In the latter embodiment, the same effect of the embodiment shown in FIG. 3 is given and moreover, the hydraulic pressure resistance is further reduced to improve the regenerative efficiency.

In accordance with the present invention, the hydraulic pump is connected through the one-way clutch to the motor for driving the pump whereby the change from the control by the flow rate control valve to the regenerative braking control of the motor and the change in the reverse direction, can be smoothly performed by the one-way clutch. Therefore, the formation of cavitation and the negative pressure caused by the competition between the motor and the check valve and other valve can be prevented. Moreover, in the feature, the electromagnetic selector valve is connected in parallel to the flow rate control valve so that the electromagnetic selector valve is opened at the time that the revolution speed of the hydraulic pump is increased over the synchronous speed of the motor, whereby the regenerative efficiency is improved and the trouble can be prevented in the case of inoperation of the regenerative braking caused by electrical power failure.

What is claimed as new and desired to be secured by Letters Patent of the United States is:

1. A hydraulic elevator comprising:

a car;

hydraulic means coupled to the car for raising and lowering the car using a hydraulic fluid;

a hydraulic pump for supplying the hydraulic fluid to the hydraulic means during raising of the car and for discharging the hydraulic fluid from the cylinder therethrough during lowering of the car;

a motor coupled to the hydraulic pump, said motor positively rotated during raising of the car and reversely rotated during lowering of the car;

flow rate control means connected between the hydraulic pump and the hydraulic means for controlling a flow rate of the hydraulic fluid flowing between the pump and the hydraulic means; and one-way clutch means connected between the motor and the pump for transmitting a positive driving force of the motor to the pump during raising of the car, and for transmitting a reverse rotating force from the pump to the motor when the revolution speed of the pump exceeds the synchronous speed of the reverse rotation of the motor during lowering of the car, whereby the motor is utilized as a dynamo to apply regenerative braking force to the pump.

2. A hydraulic elevator according to claim 1, wherein the flow rate control means comprises:

a flow rate control valve for controlling acceleration and deceleration of the car.

3. A hydraulic elevator according to claim 2, wherein the flow rate control device comprises:

a check valve connected in series to the flow rate control valve for opening and closing a flow passge between the pump and the hydraulic means.

4. A hydraulic elevator according to claim 3, wherein the flow rate control means comprises:

a selector valve connected in parallel to the flow rate control valve for bypassing the hydraulic fluid flowing through the flow rate control valve to the selector valve when the revolution speed of the pump is increased over the synchronous speed of the reverse rotation of the motor.

5. A hydraulic elevator according to claim 3, wherin the flow rate control device comprises:

a selector valve connected in parallel to a serial circuit of the flow rate control valve and the check valve for bypassing the hydraulic fluid flowing through the control valve to the selector valve when the revolution speed of the pump is increased over the synchronous speed of the reverse rotation of the motor.

* * * * *